US005112028A

United States Patent [19]

Laturner

[11] Patent Number: 5,112,028

[45] Date of Patent: May 12, 1992

[54] ROADWAY IMPACT ATTENUATOR

[75] Inventor: John F. Laturner, Carmichael, Calif.

[73] Assignee: Energy Absorption Systems, Inc., Chicago, Ill.

[21] Appl. No.: 577,638

[22] Filed: Sep. 4, 1990

[51] Int. Cl.[5] ..... A01K 3/00
[52] U.S. Cl. ..... 256/13.1; 248/66
[58] Field of Search ..... 256/13.1; 248/66

[56] References Cited

U.S. PATENT DOCUMENTS 3,674,115 7/1972 Young et al. .
3,680,662 8/1972 Walker et al. .
3,768,781 10/1973 Walker et al. .
3,944,187 3/1976 Walker .
3,982,734 9/1976 Walker .
4,023,652 5/1977 Torke .
4,674,911 6/1987 Gertz .
4,815,565 3/1989 Sicking et al. .
4,844,213 7/1989 Travis .

FOREIGN PATENT DOCUMENTS 0042645 12/1981 European Pat. Off. .
3702794A1 8/1988 Fed. Rep. of Germany .

*Primary Examiner*—Andrew V. Kundrat
*Attorney, Agent, or Firm*—Willian Brinks Olds Hofer Gilson & Lione

[57] ABSTRACT

A collapsible roadway impact attenuator includes an array of spaced parallel support elements arranged to move axially when the attenuator is struck by impacting vehicle. Elastomeric energy absorbing sheets are rigidly secured between adjacent support elements so as to extend axially and horizontally. When the attenuator is struck axially by a vehicle, the support elements move towards one another and the energy absorbing sheets form at least three inflections, thereby enhancing energy absorbing efficiency of the attenuator. Tethers can be mounted between overlying elastomeric sheets to increase the number of inflections and the energy efficiency of the attenuator.

32 Claims, 3 Drawing Sheets

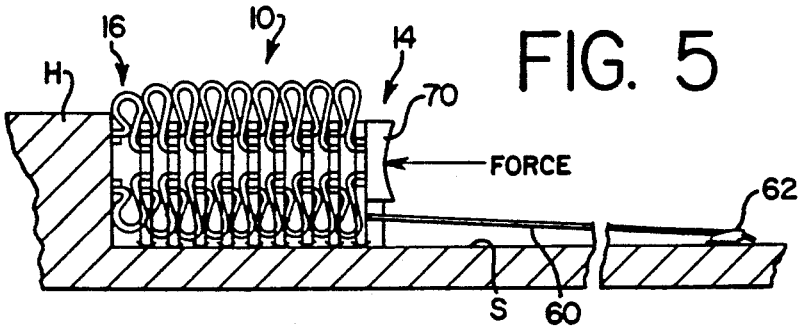
FIG. 5
FIG. 4
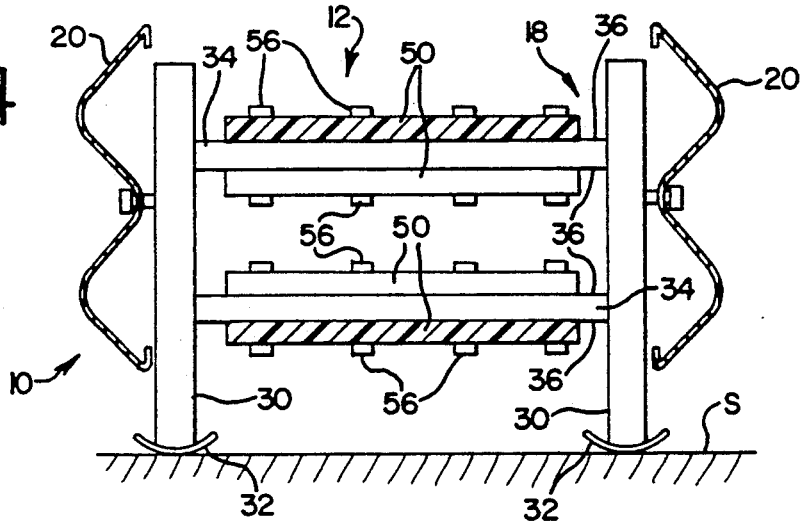
FIG. 6
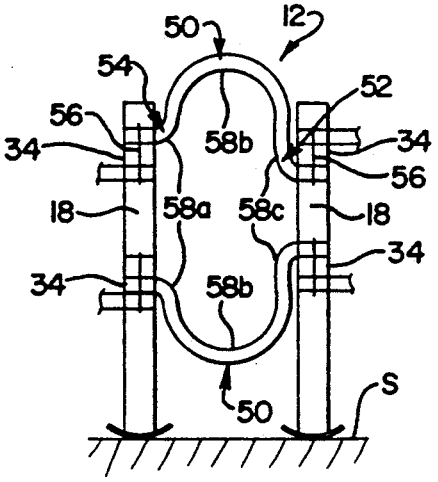
FIG. 7
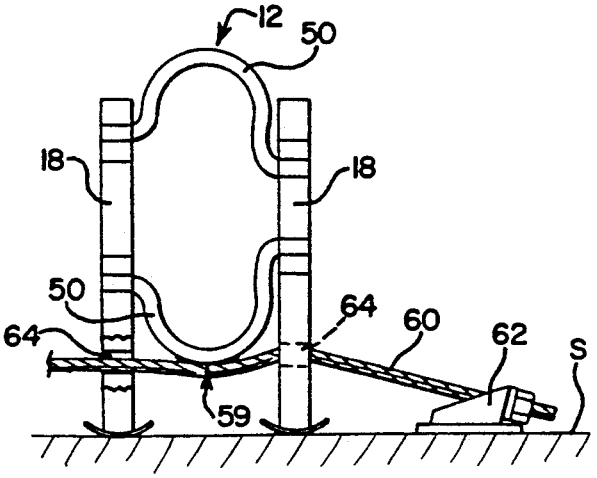

ROADWAY IMPACT ATTENUATOR

BACKGROUND OF THE INVENTION:

This invention relates to roadway impact attenuators or crash cushions used to protect the occupants of vehicles from direct impact with fixed roadside structures such as bridge abutments, piers, or the like. The preferred embodiments described below are to a great extent reusable, and are designed to absorb and harmlessly dissipate kinetic energy of an impacting vehicle with a minimum of structural damage to the impact attenuator itself.

Impact attenuation devices are often used to prevent cars, trucks and other vehicles from directly colliding with fixed structures positioned near or adjacent to a roadway. One approach to such impact attenuation devices utilizes expendable energy absorbing elements oriented in a linear array in front of the fixed highway structure. See, for example, the attenuation devices shown in Gertz U.S. Pat. No. 4,352,484 and VanSchie European Patent Doc. 0042 645. The attenuator disclosed in the Gertz patent utilizes a foamed honeycomb module to dissipate kinetic energy efficiently. The VanSchie document discloses a device utilizing axially oriented tubes which are crushed by an axially impacting vehicle. The device disclosed in the Gertz patent has achieved widespread commercial acceptance because it provides a highly efficient (and consequently compact) attenuation device. Of course, expendable energy absorbing elements must be replaced after impact. In some applications, the cost of such replacement may be considered excessive.

Another approach of the prior art focuses on low maintenance impact attenuators utilizing reusable energy absorbing elements. For example, Young U.S. Pat. No. 3,674,115 discloses a low maintenance impact attenuator that utilizes reusable fluid filled elastomeric buffer elements. Sicking U.S. Pat. No. 4,815,565 discloses a low maintenance impact attenuator that utilizes reusable elastomeric elements to resist axial collapse of the attenuator.

Low maintenance impact attenuators of the type shown in the Sicking patent do not obtain maximum efficiency from the reusable energy absorbing elements. This results in an attenuator that is relatively large, heavy, and expensive as compared to a comparable construction utilizing more efficient energy absorbing elements. Such low efficiency attenuators are unnecessarily costly, difficult to install, and prone to impact since they may intrude farther into a roadway. Such shortcomings may limit the application of low maintenance impact attenuators.

In particular, the elastomeric energy absorbing elements of the Sicking patent are shaped as thick walled cylinders. This shape requires relatively large volumes of elastomeric materials as well as relatively complex and expensive molding equipment. In addition, the cylindrical shape constrains the geometry of the impact attenuator. In particular, the thick walled cylindrical shape has a relatively low energy absorption capacity per pound of elastomeric material (efficiency) which results as described above in a longer, heavier, and higher cost impact attenuator.

It is therefore an object of this invention to provide a low maintenance impact attenuator that utilizes sheet members (preferably reusable elastomeric sheet members) as the energy absorbing elements, and to use such sheet members in a particularly efficient arrangement.

It is another object of this invention to provide a low maintenance crash cushion which is less costly, easier to install, shorter, and easier to maintain than prior art systems.

Another object is to provide an impact attenuator which utilizes bendable elastomeric sheets as energy absorbing elements.

Another object is to provide an impact attenuator utilizing elastomeric sheets as energy absorbing elements in such a way as to achieve unusually high energy absorption capacity per pound of elastomeric material.

Another object is to provide elastomeric energy absorbing elements for an impact attenuator, wherein the elements are shaped so as to be easily fabricated and inexpensive to produce.

Another object is to arrange bendable elastomeric elements in an impact attenuator such that the energy absorbing elements provide additional energy absorption through friction with other components of the attenuator.

SUMMARY OF THE INVENTION

This invention relates to improvements to a collapsible roadway attenuator of the type having a plurality of support elements arranged in a sequence along an axis, with adjacent support elements spaced from one another and at least some of the support elements moveable along the axis when the impact attenuator is struck axially by a vehicle.

According to a first aspect of this invention, a set of bendable energy absorbing sheets is provided, each having first and second ends secured to respective adjacent support elements such that the energy absorbing sheets extend generally axially between the support elements. When the support elements move toward one another as the impact attenuator collapses in response to the axial impact of a vehicle, the energy absorbing sheets bend to resist axial collapse of the impact attenuator. At least some of the energy absorbing sheets are secured to the support elements so as to form at least three inflections during axial collapse of the impact attenuator, thereby enhancing the energy absorbing efficiency of the energy absorbing sheets.

Preferably, the energy absorbing sheets provide a primary vehicle retarding force during axial collapse of the impact attenuator, and the sheets are preferably formed of an elastomeric material. By insuring that at least some of the sheets form at least three inflections, the elastomeric material is used efficiently, and the energy absorbing efficiency of the resulting attenuator is unusually high.

According to another aspect of this invention, an impact attenuator of the general type described initially above is provided with a plurality of elastomeric energy absorbing elements, each mounted between an axially adjacent pair of the support elements such that axial collapse of the impact attenuator causes the support elements to move toward one another and to bend the energy absorbing elements. Means are coupled to at least some of the energy absorbing elements intermediate the support elements for restraining movement of intermediate portions of the energy absorbing elements transverse to the axis, thereby increasing bending and energy absorbing efficiency of the energy absorbing elements during axial collapse of the impact attenuator.

Preferably, this movement restraining means comprises one or more tethers secured to the elastomeric energy absorbing element. The energy absorbing elements discussed below are arranged as sheets. However, the movement restraining means of this invention can readily be adapted to improve the energy absorbing efficiency of impact attenuators using other types of energy absorbing elements, such as the cylindrical energy absorbing elements shown in the Sicking patent identified above.

The invention itself, together with further objects and attendant advantages, will best be understood by reference to the following detailed description, taken in conjunction with the accompanying drawings.

BRIEF DESCRIPTION OF THE DRAWINGS

FIG. 4 is a cross-sectional view taken along line 4—4 of FIG. 1.

FIG. 5 is a cross-sectional view corresponding to FIG. 3 showing the impact attenuator as collapsed by an axially impacting vehicle.

FIG. 6 is a cross-sectional view of a single bay of the impact attenuator in FIG. 1 showing the attached elastomeric energy absorbing sheets partially collapsed.

FIG. 7 is a cross-sectional view corresponding to FIG. 6 showing the interaction of one of the elastomeric energy absorbing sheets with the restraining cable.

DETAILED DESCRIPTION OF THE PRESENTLY PREFERRED EMBODIMENTS

Figure 1:
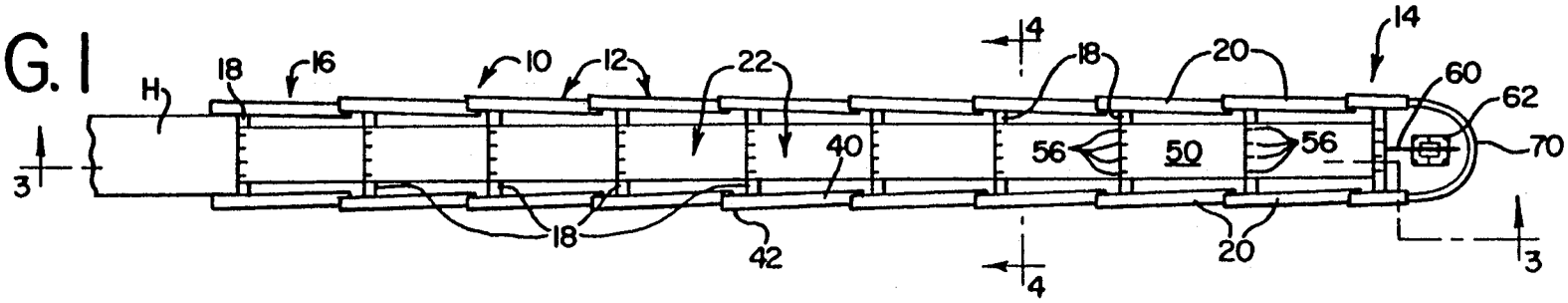
FIG. 1 is a plan view of an impact attenuator which incorporates a first presently preferred embodiment of this invention.
Figure 2:
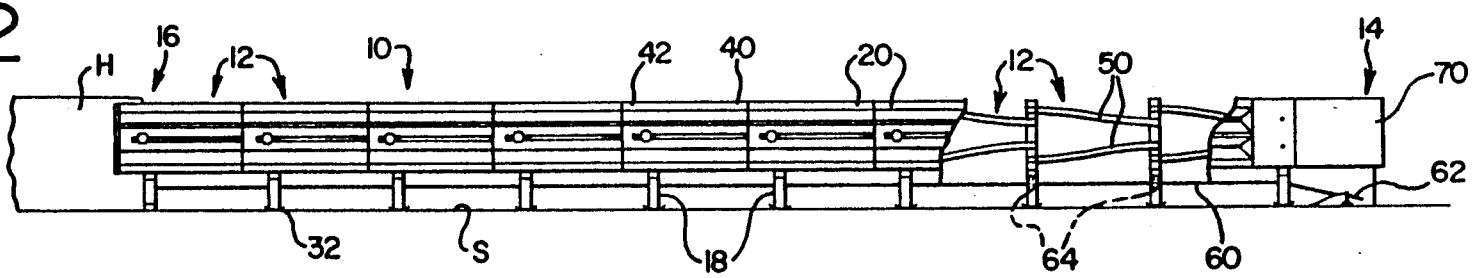
FIG. 2 is an elevational view in partial cutaway of the attenuator of FIG. 1.
Figure 3:
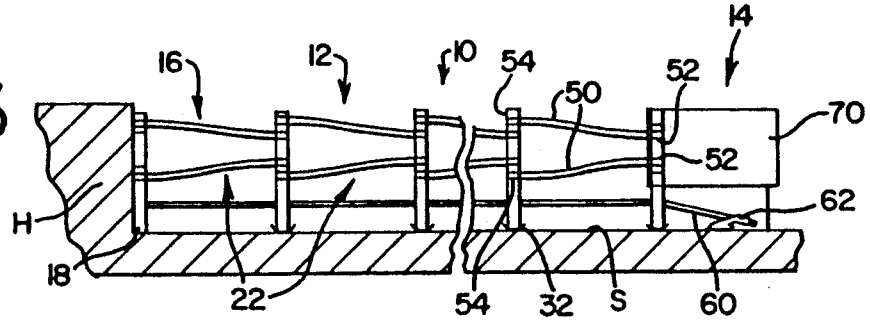
FIG. 3 is a cross-sectional view taken along line 3—3 of FIG. 1.

Turning now to the drawings, FIGS. 1–7 show various views of a first preferred embodiment 10 of the roadway impact attenuator of this invention. As best shown in FIGS. 2 and 3, the attenuator 10 is mounted on a support surface S in front of a hardpoint H. In this embodiment, the hardpoint H is the end of a concrete barrier dividing two lanes of traffic. Of course, the attenuator 10 can be used in front of other types of hardpoints as well.

As best shown in FIGS. 1 and 2, the attenuator 10 includes an axial array of bays 12 which extend linearly between a front end 14 and a back end 16 of the attenuator 10. As shown in FIG. 1, the front end 14 is situated farthest from the hardpoint H and the back end 16 is situated immediately adjacent the hardpoint H. Each of the bays 12 includes a support element 18 and a pair of side panels 20, which cooperate to surround a protected volume in which is mounted an energy absorbing assembly 22.

FIG. 4 shows a cross-sectional view that clarifies the structure of one of the support elements 18. Each of the support elements 18 includes a pair of spaced vertical legs 30 which terminate at the lower end in shoes 32 designed to facilitate sliding movement of the support element 18 on the support surface S. Two cross members 34 extend between the legs 30, and each of the cross members 34 defines two horizontally situated mounting surfaces 36 on the upper and lower surfaces of the cross member 34, respectively. Simply by way of example, the legs 30 and cross member 34 may be fabricated from rectangular tubular steel measuring two inches by three inches in outside dimension with a wall thickness of 3/16 of an inch.

Two of the side panels 20 are shown in cross-sectional view in FIG. 4. In this embodiment, the side panels 20 are conventional thrie beams. Each of the side panels 20 defines a front end 40 and a back end 42 (FIGS. 1 and 2). The front end 40 of each of the side panels 20 is hinged to a respective support element 18, and the back end 42 of each side panel 20 overlaps the next rearwardly adjacent side panel 20. Several arrangements can be used to insure that the side panels 20 allow the attenuator 10 to collapse axially when struck by an impacting vehicle. For example, the spring arrangement of the Sicking patent identified above or the fastener and slot arrangement described in U.S. Pat. No. 4,607,824 can be used. The side panels 20 overlap in a fish scale fashion to prevent a vehicle moving along the side of the attenuator 10 from snagging on the front ends 40 of the side panels 20.

FIG. 3 shows that the rearmost one of the support elements 18 is positioned directly against the hardpoint H, and thereby serves as a backing member. The remaining support elements 18 are free to slide on the support surface S, supported by the shoes 32.

FIGS. 1, 3 and 4 provide further details regarding the energy absorbing assemblies 22. In this embodiment, each of the assemblies 22 includes two rectangular elastomeric sheets 50, one overlying the other. Each of the sheets 50 defines a front end 52 and a back end 54 which extend horizontally and axially. Fasteners 56 rigidly secure the ends 52, 54 to the cross members 34 of the respective support elements 18 (FIGS. 1 and 4).

The elastomeric sheets 50 are preferably made from an elastomeric material capable of absorbing energy at high strain rates and remaining flexible during extremes of heat and cold. As an example, and not by way of limitation, the sheets 50 may be composed of natural rubber, compression molded into a rectangular prism. The hardness of the elastomeric material and the dimensions of the rectangular prism may vary with the location of the sheet 50 in the attenuator 10. For many applications, rectangular prisms made of natural rubber with a hardness of 80 Shore A per ASTM D-2240 and typical dimensions of 39 inches in length, 24 inches in width and 3½ inches in thickness have been found satisfactory for use near the back end 16 of the attenuator 10. Thinner, more flexible prisms may be preferred for the front end 14.

One important advantage of elastomeric sheets 50 is that they can be reused after an impact. However, in applications where reusability is not required it may be preferable to substitute deformable sheets such as metal sheets for the elastomeric sheets shown. In general, the energy absorbing assembly 22 made of the sheets of material should provide a primary vehicle retarding force. Of course, friction between the telescoping parts of the attenuator 10 and inertia will additionally provide vehicle retarding forces. However, the energy absorbing assembly 22 should provide a significant vehicle decelerating force, and the sheets 50 should be more than simply covers.

The number of bays 12 may vary with the posted traffic speed, but in many applications nine bays would be suitable for traffic moving at 60 miles per hour. The support members 18 are preferably arranged to insure that the elastomeric sheets 50 are centered vertically at or near the center of gravity of the anticipated impacting vehicle. commonly 21 inches.

As shown in FIG. 2, lateral stability of the attenuator 10 is enhanced by a cable 60 which is anchored at a forward end at an anchor 62 and at a rearward end at the hardpoint H. The cable 60 passes through an aperture 64 in at least one of the support elements 18. In this way, the apertured support elements 18 are braced against lateral movement when struck at an oblique angle by an impacting vehicle. Nevertheless, because the support elements 18 are free to slide along the length of the cable 60, the cable 60 does not interfere with axial collapse of the attenuator 10 in response to an axially impacting vehicle. A nose piece 70 extends between the two forward most side panels 20 to provide a rounded surface at the front end 14 of the attenuator 10.

FIG. 3 shows a cross-sectional view of the attenuator 10 prior to axial impact, with the support elements 18 and the elastomeric sheets 50 in their original, undeformed position. FIG. 5 shows a comparable cross-sectional view of the attenuator 10 after it has been collapsed axially by an impacting vehicle. Note that the support elements 18 have been moved rearwardly along the cable 60, and that the elastomeric sheets 50 have been bent outwardly by the moving support elements 18. Friction between the side panels 20 will typically hold the attenuator 10 in the collapsed position of FIG. 5 after the impacting vehicle has been brought to a rest. The elastomeric sheets 50 preferably (though not necessarily) are predisposed to bend outwardly rather than inwardly to maximize efficiency. This can be done by properly orienting the ends of the sheets 50, or by providing a slight outward bow to the sheets 50 as initially mounted.

FIG. 6 shows a more detailed view of a pair of support elements 18 and the interconnected elastomeric sheets 50 when partially compressed. Because the ends 52, 54 are oriented axially and rigidly mounted to the cross members 34, each of the elastomeric sheets 50 is caused to bend at three inflections or fold lines, 58*a*, 58*b*, 58*c*. This is quite different from the folding of prior art cylindrical elastomeric elements, which typically provide only a single inflection on the upper half of the cylinder and a single inflection on the lower half of the cylinder. Three inflections 58*a*, 58*b*, 58*c* in each elastomeric sheet 50 insure that an unusually large percentage of the elastomeric material is placed in strain, and thereby that an unusually high amount of kinetic energy is absorbed for a given weight of elastomeric material. In this way high energy absorbing efficiencies are obtained, and the attenuator 10 can be made lighter, shorter and less expensive than attenuators which strain elastomeric energy absorbing elements less efficiently.

In an impact attenuator it is very desirable to prevent elastomeric energy absorbing elements from coming into contact with the roadway surface or support surface S during collapse, since such contact results in excessive damage to the energy absorbing elements and can even result in unpredictable performance of the attenuator. Another important advantage of the arrangement of the elastomeric sheets 50 is that since the sheets 50 are positioned axially and preferably essentially horizontally in the bays 12, the sheets 50 will project less distance beyond the confines of the bays 12 upon collapse of the attenuator 10. For this reason, the elastomeric sheets 50 are well suited for use in bays 12 which have a greater axial length. Such a large bay spacing allows the total number of support elements 18 and side panels 20 to be reduced for a given length attenuator 10, and can thereby result in further increases in efficiency and reductions in cost.

FIG. 7 shows another important aspect of the attenuator 10. The lower elastomeric sheets 50 are positioned such that during axial collapse of the attenuator 10, central portions of the lower elastomeric sheets 50 deform against the cable 60. This contact between the elastomeric sheets 50 and the cable 60 absorbs a portion of the kinetic energy of the impacting vehicle through friction. If desired, a wear element 59 can be placed on the lower elastomeric sheets 50 to reduce or eliminate damage to the elastomeric sheets 50 by the cable 60.

Figure 8:
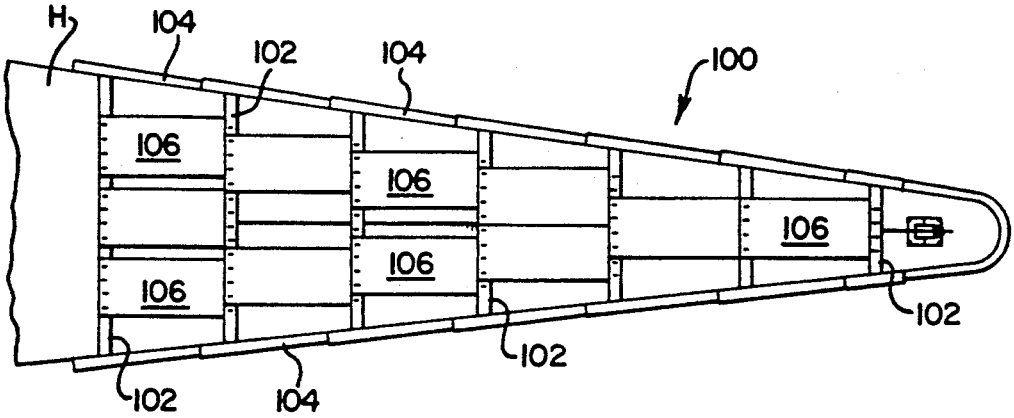
FIG. 8 is a plan view of a second preferred embodiment of this invention.

FIG. 8 shows a plan view of a second preferred embodiment 100 of this invention, which is constructed using similar principles to those described above. In, this case the support elements 102 increase in lateral width from front to back and the side panels 104 are arranged in a V-shape as shown. One advantage of this arrangement is that a greater number of elastomeric sheets 106 can be employed between the support elements 18 at the back end of the attenuator 100 than at the front end. In this way, increasing deceleration forces can be provided as the attenuator 100 progressively collapses. In the attenuator 100 of FIG. 8 the bays at the front end of attenuator 100 include only a single pair of elastomeric sheets 50, while those in the center each include four elastomeric sheets, and the rear most bay includes six elastomeric sheets.

Figure 9:
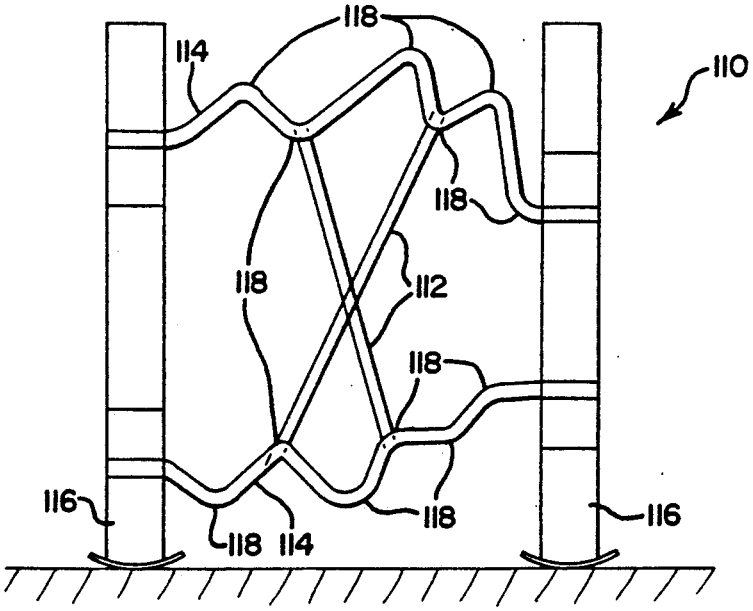
FIG. 9 is a cross-sectional view corresponding to FIG. 6 of a third preferred embodiment of this invention.

FIG. 9 shows a part of a third preferred embodiment 110 of this invention in a view corresponding to FIG. 6 above. This third embodiment 110 is identical to the attenuator 10 described above, except that two tethers 112 are arranged to extend between the upper and lower elastomeric sheets 114 in at least some of the bays. These tethers 112 act as movement restraining means to restrain outward bending of the elastomeric sheets 114 during axial collapse of the attenuator 110. In general, the tethers 112 are positioned intermediate of the support elements 116, and they operate to increase the number of inflections, and thereby the energy absorbing efficiency of the elastomeric sheets 114. As the elastomeric sheets 114 buckle outwardly, the tethers 112 restrain further outward movement of selected intermediate portions of the sheets 114 by transferring equal and opposite buckling forces to the selected portions. In this way, the elastomeric sheets 114 are caused to buckle at an increased number of inflections or fold lines 118. A higher percentage of the elastomeric material is placed in strain and a higher resistance force to axial collapse is provided.

Though the tethers 112 have been shown in FIG. 9 in combination with elastomeric sheets 114, it is not required in all embodiments that the elastomeric elements be sheetlike in configuration. In particular, the tethers 112 can be used to enhance the energy absorbing efficiency of cylindrical elastomeric elements of the type shown in the Sicking patent identified above. In this case, the upper and lower halves of the elastomeric cylinder correspond to the sheets 114 of FIG. 9, and internally arranged tethers 112 can be used to increase the number of inflections 118 and the energy absorbing efficiency of the elastomeric member.

Of course, it should be understood that a wide range of changes and modifications can be made to the preferred embodiments described above. In particular, details of construction regarding materials, geometries, and methods for securing the various elements on the attenuator together can all be modified as appropriate for particular applications. It is therefore intended that the foregoing detailed description be regarded as illustrative rather than limiting, and that it be understood that it is the following claims, including all equivalents, which are intended to define the scope of this invention.

I claim:

1. In a collapsible roadway impact attenuator of the type comprising a plurality of support elements arranged in a sequence along an axis, with adjacent support elements spaced from one another and at least some of the support elements supported for movement along the axis when the impact attenuator is struck axially by a vehicle, the improvement comprising:

a set of bendable energy absorbing sheets, each having first and second ends secured to respective adjacent support elements such that the energy absorbing sheets extend generally axially between the support elements and, when the support elements move toward one another when the impact attenuator is struck axially by a vehicle, the energy absorbing sheets bend to resist axial collapse of the impact attenuator;

at least one of said energy absorbing sheets secured to the support elements to form along said axis at least one outwardly convex portion and at least one outwardly concave portion during axial collapse of the impact attenuator, thereby enhancing energy absorbing efficiency of the energy absorbing sheets;

said energy absorbing sheets providing a primary vehicle retarding force during axial collapse of the impact attenuator.

2. The invention of claim 1 wherein the ends of the energy absorbing sheets are oriented substantially axially and are rigidly secured to the respective support elements.

3. The invention of claim 1 or 2 wherein said energy absorbing sheets comprise an elastomeric material.

4. The invention of claim 1 or 2 wherein said energy absorbing sheets are formed of an elastomeric material.

5. The invention of claim 4 wherein the elastomeric material comprises natural rubber.

6. The invention of claim 1 or 2 further comprising:

means, coupled to at least some of the energy absorbing sheets intermediate the support elements, for restraining movement of intermediate portions of the energy absorbing sheets transverse to the axis, thereby further increasing bending and energy absorbing efficiency of the energy absorbing sheets during axial collapse of the impact attenuator.

7. The invention of claim 6 wherein the energy absorbing sheets are mounted to the support elements in pairs overlying one another, and wherein the movement restraining means comprises at least one tether mounted between one of the pairs of overlying energy absorbing sheets.

8. The invention of claim 2 wherein the ends of the energy absorbing sheets are oriented horizontally.

9. The invention of claim 1 further comprising a plurality of overlapping side panels positioned adjacent respective ones of the support elements.

10. The invention of claim 1 or 2 further comprising an axially extending cable slidingly coupled to at least one of the support elements to strengthen the impact attenuator against lateral impact.

11. The invention of claim 10 wherein the cable is positioned to engage first ones of the energy absorbing sheets when the energy absorbing sheets bend during axial collapse of the impact attenuator, thereby creating friction between the cable and the first ones of the energy absorbing sheets.

12. The invention of claim 1 wherein the impact attenuator defines a front end and a back end, and wherein the energy absorbing sheets are arranged to provide greater resistance to axial collapse of the impact attenuator at the back end than at the front end.

13. In a collapsible roadway impact attenuator of the type comprising a plurality of support elements arranged in a sequence along an axis, with adjacent support elements spaced from one another and at least some of the support elements supported for movement along the axis when the impact attenuator is struck axially by a vehicle, and a plurality of overlapping side panels positioned adjacent respective ones of the support elements; the improvement comprising:

at least one pair of generally axially extending elastomeric energy absorbing sheets mounted between each adjacent pair of the support elements, each energy absorbing sheet secured to the respective support elements at axially extending end portions such that each sheet forms along said axis at least one outwardly convex portion and at least one outwardly concave portion when the support surfaces move toward one another during axial collapse of the impact attenuator.

14. The invention of claim 13 wherein the energy absorbing sheets are generally horizontal, wherein the support elements each define at least two vertically spaced horizontal support surfaces, and wherein the energy absorbing sheets are rigidly secured to the support surfaces.

15. The invention of claim 13 wherein the energy absorbing sheets comprise natural rubber.

16. The invention of claim 13 further comprising means, coupled to at least some of the energy absorbing sheets intermediate the support elements, for restraining movement of intermediate portions of the energy absorbing sheets transverse to the axis, thereby further increasing bending and energy absorbing efficiency of the energy absorbing sheets during axial collapse of the impact attenuator.

17. The invention of claim 16 wherein the movement restraining means comprises at least one tether coupled between the energy absorbing sheets in one of the pairs.

18. The invention of claim 13 further comprising an axially extending cable slidingly coupled to at least one of the support elements to strengthen the impact attenuator against lateral impact.

19. The invention of claim 18 wherein the cable is positioned to engage first ones of the energy absorbing sheets when the energy absorbing sheets bend during axial collapse of the impact attenuator, thereby creating friction between the cable and the first ones of the energy absorbing sheets.

20. The invention of claim 13 wherein the impact attenuator defines a front end and a back end, and wherein the energy absorbing sheets are arranged to provide greater resistance to axial collapse of the impact attenuator at the back end than at the front end.

21. In a collapsible roadway impact attenuator of the type comprising a plurality of support elements arranged in a sequence along an axis, with adjacent support elements spaced from one another and at least some of the support elements supported for movement along the axis when the impact attenuator is struck axially by a vehicle, the improvement comprising:

a plurality of elastomeric energy absorbing elements, each mounted between an axially adjacent pair of the support elements such that axial collapse of the impact attenuator causes the support elements to move toward one another and to bend the energy absorbing elements; and means, coupled to at least some of the energy absorbing elements intermediate the support elements, for restraining movement of intermediate portions of the energy absorbing elements transverse to the axis, thereby increasing bending and energy absorbing efficiency of the energy absorbing elements during axial collapse of the impact attenuator.

22. The invention of claim 21 wherein the movement restraining means comprises a plurality of tethers mounted to the energy absorbing elements.

23. The invention of claim 21 wherein at least some of the energy absorbing elements overlie one another, and wherein the movement restraining means comprises a plurality of tethers, each mounted to extend between the intermediate portions of a pair of overlying energy absorbing elements.

24. In a collapsible roadway impact attenuator of the type comprising a plurality of support elements arranged in a sequence along an axis, with adjacent support elements spaced from one another and at least some of the support elements supported for movement along the axis when the impact attenuator is struck axially by a vehicle, the improvement comprising:

a plurality of elastomeric energy absorbing sheet elements, each mounted between an axially adjacent pair of the support elements such that axial collapse of the impact attenuator causes the support elements to move toward one another and to bend the energy absorbing elements; and at least one of said energy absorbing elements secured to the support elements to form along said axis at least one outwardly convex portion and at least one outwardly concave portion during axial collapse of the impact attenuator, thereby enhancing energy absorbing efficiency of the energy absorbing elements;

said energy absorbing elements providing a primary vehicle retarding force during axial collapse of the impact attenuator.

25. The invention of claim 24 wherein said energy absorbing elements comprise an elastomeric material.

26. The invention of claim 24 wherein said energy absorbing elements are formed of an elastomeric material.

27. The invention of claim 26 wherein the elastomeric material comprises natural rubber.

28. The invention of claim 24 further comprising:

means, coupled to at least some of the energy absorbing elements intermediate the support elements, for restraining movement of intermediate portions of the energy absorbing elements transverse to the axis, thereby further increasing bending and energy absorbing efficiency of the energy absorbing elements during axial collapse of the impact attenuator.

29. The invention of claim 24 further comprising a plurality of overlapping side panels positioned adjacent respective ones of the support elements.

30. The invention of claim 24 further comprising an axially extending cable slidingly coupled to at least one of the support elements to strengthen the impact attenuator against lateral impact.

31. The invention of claim 30 wherein the cable is positioned to engage at least some of the energy absorbing elements when the energy absorbing elements bend during axial collapse of the impact attenuator, thereby creating friction between the cable and the respective energy absorbing elements.

32. The invention of claim 24 wherein the impact attenuator defines a front end and a back end, and wherein the energy absorbing elements are arranged to provide greater resistance to axial collapse of the impact attenuator at the back end than at the front end.

* * * * *